US005414437A

United States Patent [19]

Mahnad

[11] Patent Number: 5,414,437

[45] Date of Patent: May 9, 1995

[54] DUAL FREQUENCY INTERLEAVED SLOT ANTENNA

[76] Inventor: Ali R. Mahnad, 5063 Olive Oak Way, Carmichael, Calif. 95608

[21] Appl. No.: 84,285

[22] Filed: Jun. 28, 1993

[51] Int. Cl.[6] ..... H01Q 13/12

[52] U.S. Cl. ..... 343/770; 343/890

[58] Field of Search ..... 343/767, 770, 771, 890, 343/891, 790, 791; H01Q 5/00, 5/01, 13/10, 13/12, 13/22

[56] References Cited

U.S. PATENT DOCUMENTS 2,767,397 10/1956 Byrne ..... 343/771
4,180,820 12/1970 Johns ..... 343/798

OTHER PUBLICATIONS

Broadcast Engineering Aug. 1992 article entitled HDTV: Antennas for Terrestrial Services, pp. 38–46.

*Primary Examiner*—Michael C. Wimer
*Attorney, Agent, or Firm*—Flehr, Hohbach, Test, Albritton & Herbert

[57] ABSTRACT

A dual frequency slot type antenna with slots providing donut-type radiating patterns on a verticals mast at a first frequency and having a null area between the vertically located slots where an additional collar is placed to provide for the transmission of a second frequency which is generally of the same UHF range as the first.

2 Claims, 3 Drawing Sheets

DUAL FREQUENCY INTERLEAVED SLOT ANTENNA

The present invention is directed to a dual frequency slot type antenna and more specifically to an antenna especially useful for high definition television (HDTV).

BACKGROUND OF INVENTION

Implementation of high definition television (HDTV) in the United States is now undergoing testing by the Federal Communications Commission. It is contemplated that such an HDTV system will require additional channel allocations on UHF frequencies which will carry a digital signal. Thus alterations to existing transmitting antennas will be required. The existing TV signal is normally designated an NTSC signal which is analog. It is contemplated that the HDTV digital signal will be located on the same transmission tower. However, the normal slot antennas in the UHF frequency range cannot simultaneously serve two separate UHF channels efficiently. In such cases, the HDTV operation will require a separate antenna in a different location of the tower.

Since the physical location of an antenna on a transmitting tower used by several TV stations is quite critical, to locate the HDTV antenna on another part of the tower, or even relocate the entire antenna installation is not desirable.

OBJECT AND SUMMARY OF INVENTION

It is a general object of the present invention to provide an improved dual frequency antenna especially suited for HDTV.

In accordance with the above object there is provided a radio frequency antenna for radiating a pair of first and second radio frequency signals comprising a vertical antenna mast having first and second pairs of slot type radiating elements spaced on the mast the wavelength of the first frequency, the slot pairs having a null area between them. Third and fourth pairs of slot type radiating elements are included in a pair of collars fastened around the mast and vertically spaced the wavelength of the second frequency, the collars being located in a null area.

DETAILED DESCRIPTION OF PREFERRED EMBODIMENT

Figure 1:
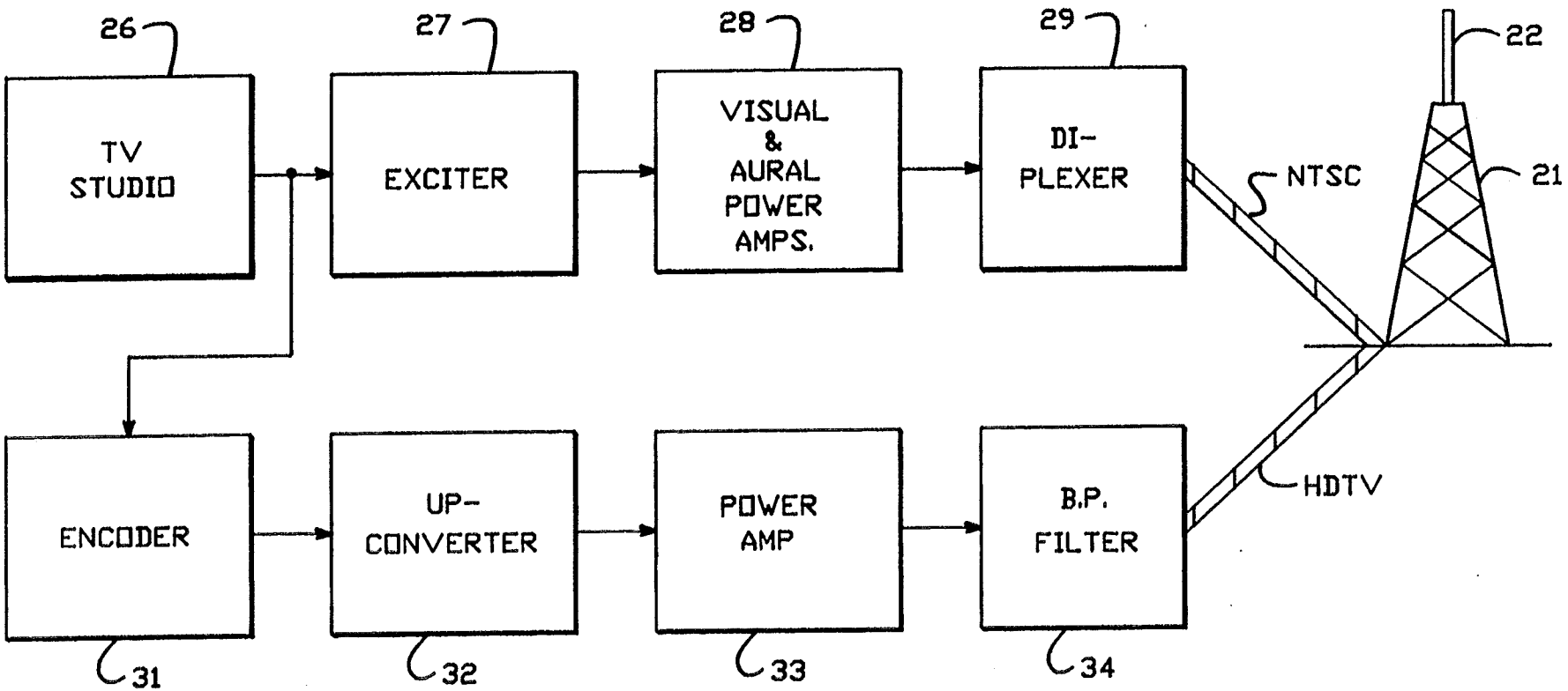
FIG. 1 is a block diagram of a generalized transmitter system as it would drive the antenna of the present invention.

FIG. 1 illustrates a proposed HDTV system where the transmission tower 21 which with its antenna on a vertical support mast 22 will radiate or transmit both an NTSC signal received on the coaxial cable 23 and coupled to the tower and a HDTV signal on the coaxial cable or waveguide 24. In general the NTSC signal for a slot antenna is in the UHF band which is 470–800 MHz. In general it is contemplated that the extra HDTV channels will be the UHF channels which were used for spacing.

The remainder of FIG. 1 are standard transmitting system blocks. From a television studio 26, one feed extends to an NTSC channel including an exciter 27, visual and aural power amplifiers 28 and a combining diplexer 29 which feeds the coaxial waveguide 23 and connects to the antenna on mast 22. The second channel from the TV studio 26 includes the encoder 31 to convert the information to digital, an upconverter 32, power amplifier 33, and a band pass filter 34 connecting to the HDTV coaxial cable 24. The HDTV signal as well as being digital is contemplated to be of the spread spectrum type.

Figure 2:
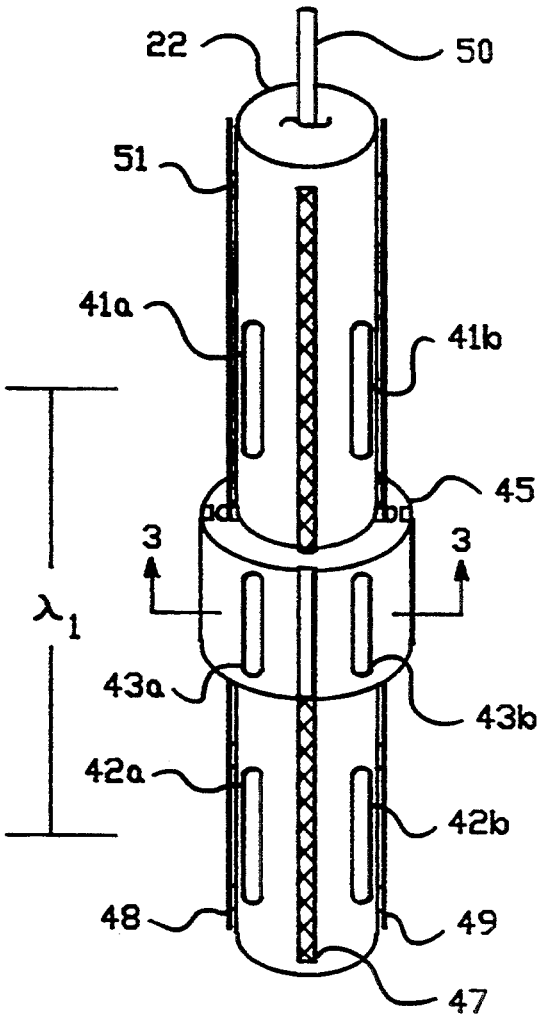
FIG. 2 is a simplified perspective view of the antenna of the present invention.

FIG. 2 illustrates the specific slot type antenna of the present invention where at least first and second pairs of slots shown here as 41*a*, 41*b*, and 42*a*, 42*b* provide radiating elements for a fairly narrow frequency bandwidth generally in the UHF range. The slots are vertically spaced on the mast the wavelength of the first and lower frequency as indicated. Then to provide a slightly higher second frequency, third and fourth pairs of slot type elements (only one of which 43*a*, 43*b* is illustrated in FIG. 2) are included in a first collar 45 which is positioned around the mast 22. It is located in the null area between the first and second pairs of lower frequency $f_1$ radiating elements.

Figure 4:
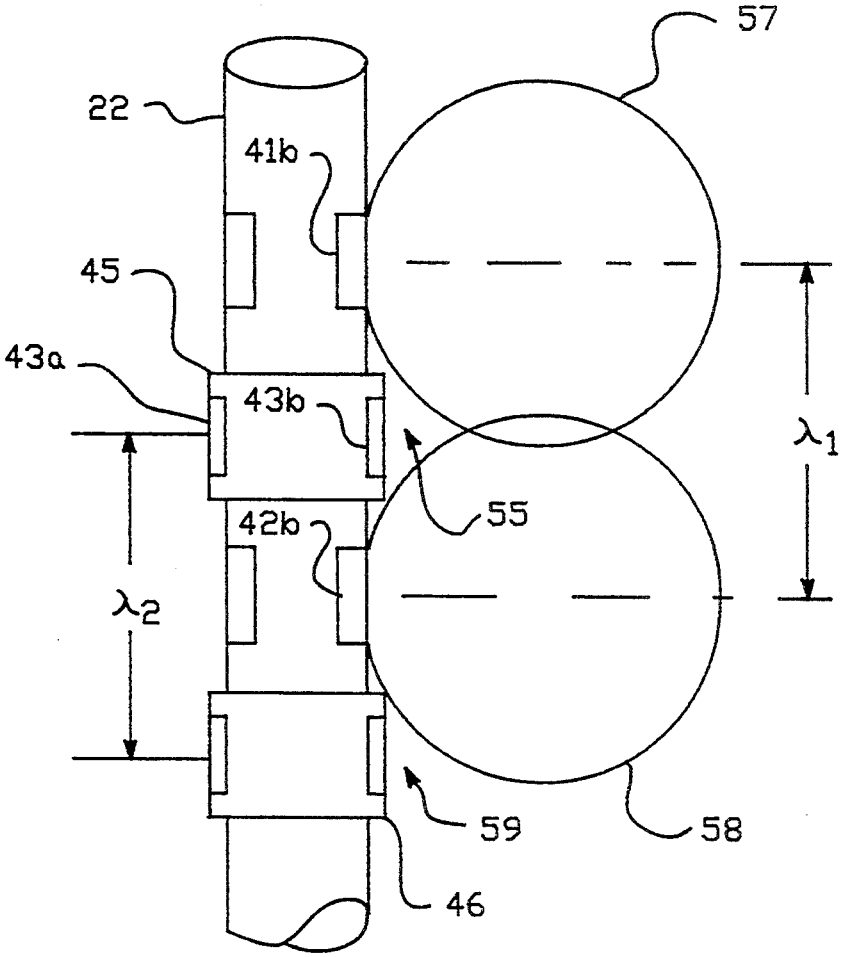
FIG. 4 is an elevational view showing the radiation pattern of a portion of the antenna of the present invention.

In FIG. 4 a second collar 46 is also indicated. And of course this is spaced a wavelength apart from collar 45. While only two slots are shown in FIG. 2, a number of slots, perhaps four or six, would continue around the backside of the mast and collar (not shown) to provide for full omnidirectional radiation.

As illustrated in FIG. 2, the collar 45 is electrically shorted to the mast 22 and in the preferred embodiment is fed by an external strip line 47 with other collars being fed by other strip lines indicated as 48 and 49, all of them separated from and electrically insulated from the mast by insulators; for example, 51.

Figure 3:
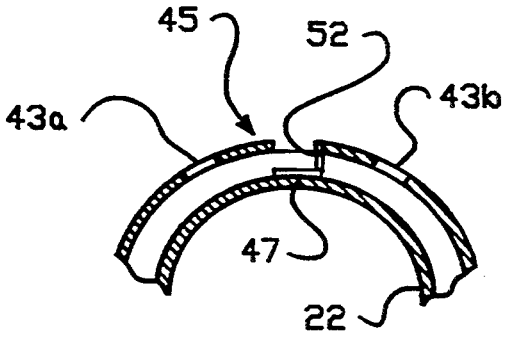
FIG. 3 is a simplified cross-sectional view taken along the line 3—3 of FIG. 2 showing the radiation pattern of a portion of the antenna of the present invention.

As shown in FIG. 3, the strip line 47 is tied into the collar by an upstanding "L" connection indicated at 52.

FIG. 4 illustrates the radiation patterns of slots 41*b* and 42*b*, the slots being spaced a wavelength apart with several slots in the same radial plane of the mast 22. A taurus or donut-shaped radiation pattern thus will be produced. And between the two donut-shaped radiation patterns 56 and 57, there is a null area 55. And there is another null area 59 at the lower collar 46 59. Thus the collars are placed or located in these null areas so that they will not interfere with the main radiation patterns 57, 58 of the first and second slot type radiating elements 41*b* and 42*b*.

From an antenna feed point of view for the slots 41*b* and 42*b*, etc., there is an internal waveguide or coaxial cable indicated as 50 in FIG. 2 as is well known in the art. Generally to prevent interference (both electrical and physical) the external strip line 47 is an ideal solution.

Thus an improved dual frequency slot type antenna has been provided.

What is claimed is:

1. A radio frequency antenna for simultaneously radiating a pair of first and second radio frequency signals comprising:

a vertical antenna mast having first and second slot radiation pairs vertically spaced on said mast the wavelength of said first frequency signal, said first and second slot pairs having a radiation pattern with a null area between them;

third and fourth slot radiation pairs respectively included in a pair of collars positioned around said mast and vertically spaced the wavelength of said second frequency signal, said collars being located in said null area.

2. An antenna as in claim 1 wherein said collars are electrically shorted to said mast and are fed by stripline means mounted by insulators externally on said mast and said first and second slot radiation pairs are fed by conductor means internally to said mast.

* * * * *